United States Patent [19]

Kulik

[11] 4,437,198

[45] Mar. 20, 1984

[54] METHOD OF ARTICULATING A WORK SUPPORTING SURFACE

[75] Inventor: Alphonse C. Kulik, Ipswich, Mass.

[73] Assignee: USM Corporation, Farmington, Conn.

[21] Appl. No.: 315,414

[22] Filed: Oct. 27, 1981

[51] Int. Cl.[3] ..... A43D 23/04

[52] U.S. Cl. ..... 12/145

[58] Field of Search ..... 12/10.1, 10.2, 10.21, 12/10.3, 10.4, 10.5, 12.4, 12.41, 12.5, 126, 127, 145

[56] References Cited

U.S. PATENT DOCUMENTS 2,078,577 4/1937 Lawson ..... 12/126

3,660,857 5/1972 Heal et al. ..... 12/127

*Primary Examiner*—Werner H. Schroeder

*Assistant Examiner*—Steven N. Meyers

*Attorney, Agent, or Firm*—Donald N. Halgren

[57] ABSTRACT

A method of articulating a work support surface in a machine by attaching the work support surface to a support arm; journalling the support arm through a first axis which is arranged in a pair of parallel slots in a pair of frame members secured to the machine and then arranging a toggle linkage between the first axis and a second fixed axis secured to the frames, whereby reciprocation of an elongated member attached to said first axis causes said support surface to move rearwardly as said support arm thereattached is supportively moved between said frame members.

9 Claims, 4 Drawing Figures

METHOD OF ARTICULATING A WORK SUPPORTING SURFACE

BACKGROUND OF THE INVENTION (1) Field of the Invention

This invention relates generally to mechanisms for moving a work supporting surface, and more particularly to mechanisms to limit and control the motion of those support surfaces.

(2) Prior Art

In the course of lasting certain types of shoes, such as those called "high walled" types, that is, boots, work and safety shoes or the like, there may be little room above the last support, to properly maneuver a lasted upper to arrange the upper material within the pincers and at the same time, not scuff or damage the toe of the upper. Another concern of shoe machine operators occurs when there is not much of a margin of an upper for the pincers of the lasting machine to grab onto. This is called having "short stock", and is a hindrance to the shoe machine operator, who must then try to manually rearrange the upper on the last after he removes it from the lasting machine.

It is then an object of the present invention to provide a shoe lasting machine with a mechanism to permit "high walled" footwear to be lasted on a standard shoe lasting machine, which mechanism may be adjustable to permit the shoe machine to accommodate various sizes and ranges of "high walled" footwear.

It is a further object of the present invention to provide a shoe lasting machine with a mechanism to permit "short stock" uppers to be lasted by the machine operator, without having to unnecessarily remove the unlasted short stock upper and last from the shoe machine and make manual adjustments thereto.

BRIEF SUMMARY OF THE INVENTION

The present invention comprises an insole support plate positioning mechanism arranged on a shoe lasting machine which support plate is adapted to receive an upper and an insole on a last, bottom-downwardly and to provide a tiltable range of movement in the support plate as well as reciprocal movement capabilities of the entire shoe support plate, permitting high walled footwear or "short stocked" lasts to be accommodated easily thereon.

Means are provided to shuttle the insole support plate heelwardly a selected distance to permit a last having an insole and upper thereon to be received, bottom down, to return the support plate toewardly and to tilt the support plate and last thereon, downwardly, if necessary, permitting the upper to be readily received between the front pincers.

The shuttle means comprise a link arrangement which are toggled between a pair of frames. The toggle links comprise a forward pair of arms having a forward axis which slides transversely along a slot of the frames. The insole support plate is attached to a support arm which slides on guides between the frames and is attached to the axis between the forward pair of toggle arms. A rearward pair of toggle arms are pivotally connected to the frame at one end thereof, and are pivotally connected to the distal ends of the forward arms, through a common toggle axis extending transversely thereacross. The common toggle axis extends beyond one side of one of the arms and is pivotally connected to a shaft of a piston in a pressurizable toggle break cylinder. The pressurizable toggle break cylinder is attached to the side of one of the frame members. The swingable end of one of the forward arms has an extension thereon which has an adjustable bolt on its distal end thereof. The extension swings when the toggle is "made" or "broken". A switch is attached to the frame so as to be contacted by the adjustable bolt when the toggle linkage is "made" or fully straight out.

The frames of the insole support plate positioning mechanism are attached to the upper end of a last post on a shoe lasting machine. An elongated member extends from the heelward side of the insole support plate support arm between the frame members, and is pivotally connected intermediate thereon, to the distal end of a bifurcated shaft on the end of a piston rod reciprocably disposed on a piston in a pressurizable cylinder. The positioning cylinder is attached to the frame of the lasting machine. The elongated member extends beyond the pivotal connection with the positioning cylinder, and into rolling contact with a pressurizable tilt cylinder, which distal end of the elongated member has a wheel rotatably secured thereto, and thus comprises the rolling contact with the distal end of the tilt cylinder which is also secured to the frame of the lasting machine.

The upper portions of the elongated member comprises a first leg that extends from the wheel which is in contact with the tilt cylinder to the forwardmost axis in the link arrangement. The upper portion of the elongated member has a second leg thereadjacent which has an adjustable bolt arranged through its lower end in registration with a tab extending from a portion of the first leg. The second leg is pivotally arranged about the forward axis of the link arrangement and extends therepast to comprise support arm of the insole support plate.

A camming mechanism is arranged between the first leg and one of the sides of the frame members. A cam shaped generally like a parallelogram is secured to a side of the first leg and extends through a cam slot in one side of the frame members. The cam slot is in the general shape of two contiguous parallelograms, forming an obtuse angle with respect to one another.

In operation of the insole plate positioning mechanism, prior to the installation of a last with an upper and insole thereon, the positioning plate operating cylinder is activated to cause its piston and piston rod therewith to retract into the cylinder, while at the same time, the toggle break cylinder is pressurized. This causes the insole support plate and suppoting arm, as well as the elongated member attached to the bifurcated shaft, to be retracted heelwardly a finite distance, which distance is governed by the length of the slot in the frame members the forward axis may slide in, as well as what may be permitted by a shuttle adjustment mechanism. The toggle break cylinder thus forces the intermediate axis upwardly causing the forward and rearward toggle links to move with respect to one another thus helping pull the support plate heelwardly, and causing the cam on the side of the upper end of the elongated member to slide towards the heelward end of the cam slot in one of the frame members, thus preventing the support plate from tilting upwardly or downwardly.

A ribbed (or flat lasted) insole may then be arranged upon the insole support plate, and the positioning plate operating cylinder may be pressurized to now push against the elongated member, causing the forwardmost axis of the toggle links to slide toewardly in their slot.

The toggle break cylinder is retracted to help straighten the toggle links, and the insole support plate has shuttled toewardly as far as possible, and the cam has moved as toeward as possible in the cam slot in the frame of the mechanism. The cam may then be moved downwardly along the downwardly directed portion of the cam slot by advancing movement of the tilt cylinder, the effect of which is, to tilt the insole support plate upwardly for proper adjustment of any last and upper thereon.

The straightening out of the toggle linkage may cause the switch thereadjacent to be contacted by the extension on the toggle link, activating the pincer closing sequence for pulling the upper snugly about the last, prior to wiping.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENT

Figure 1:
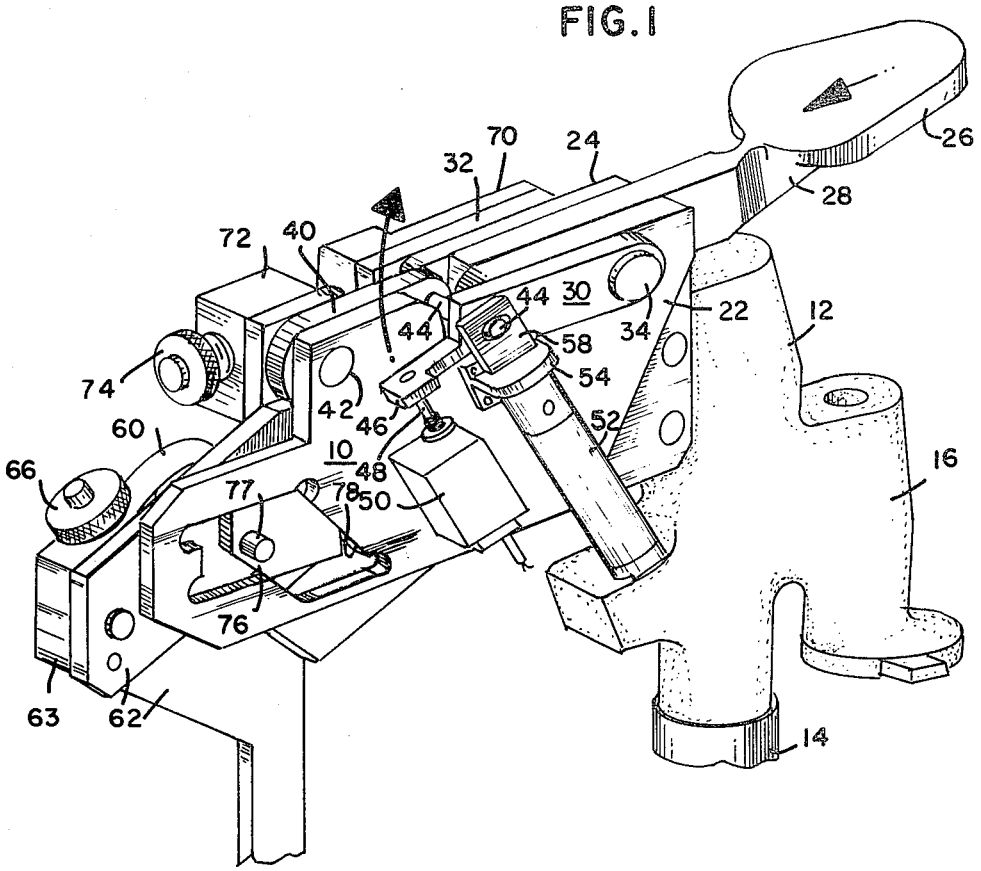
FIG. 1 is a perspective view of an insole support plate mechanism adaptable to fit in a shoe lasting machine.

Referring now to the drawings in detail and particularly to FIG. 1, there is shown an insole support plate mechanism 10 mounted to the top of a housing 12 on a shoe lasting machine last post 14. The housing 12 includes a journal box 16 on a front edge thereof for guiding an adjustable shaft 18 and a U-shaped cement nozzle 20 thereon, shown in dashed lines in FIG. 2. The insole support plate mechanism 10, comprises a pair of frame members 22 and 24, arranged in parallel planes bolted to both sides of the housing 12, as shown in FIG. 1.

An insole support plate 26 is arranged generally above the nozzle 20, and which plate 26 is attached to the distal end of a forward support arm 28. The forward support arm 28 is arranged to be slidably movable along its longitudinal axis between the parallel frame members 22 and 24. A pair of first pivot arms 30 and 32 are disposed outwardly of the frame members 22 and 24, and are connected at their forward ends by an axis 34 which extends through an elongated slot 36, in both the frame members 22 and 24, which slot 36 is partially shown in FIG. 3. The axis 34 is secured to a heelward portion of the forward support arm 28.

A second pivot member 40 has its heelward end journalled on an axis 42. The second pivot member 40 is also secured to the parallel frame members 22 and 24. The first pivot arms 30 and 32 at their heelward ends are pivotally connected, by a common axis 44 to the forward end of the second pivot member 40.

One pivot arm 30 has an extension 46 extending from the distal end thereof, the extension 46 having an adjustable bolt 48 threadably received therethrough. An actuatable control switch 50 is secured to the side of the frame member 22 and is in contactual alignment with the adjustable bolt 48 on the extension 46. The control switch 50 is connected, through proper circuitry, to control and power means, not shown, utilizable to motivate the shoe lasting machine.

A pressurizable toggle break cylinder 52 is secured by a bracket 54 to the side of frame member 22. A piston, not shown, and a piston rod 56 extends from the toggle break cylinder 54 and has a block 58 on the distal end of the piston rod 56, which block 58 is journalled onto one end of the common axis 44.

Figure 2:
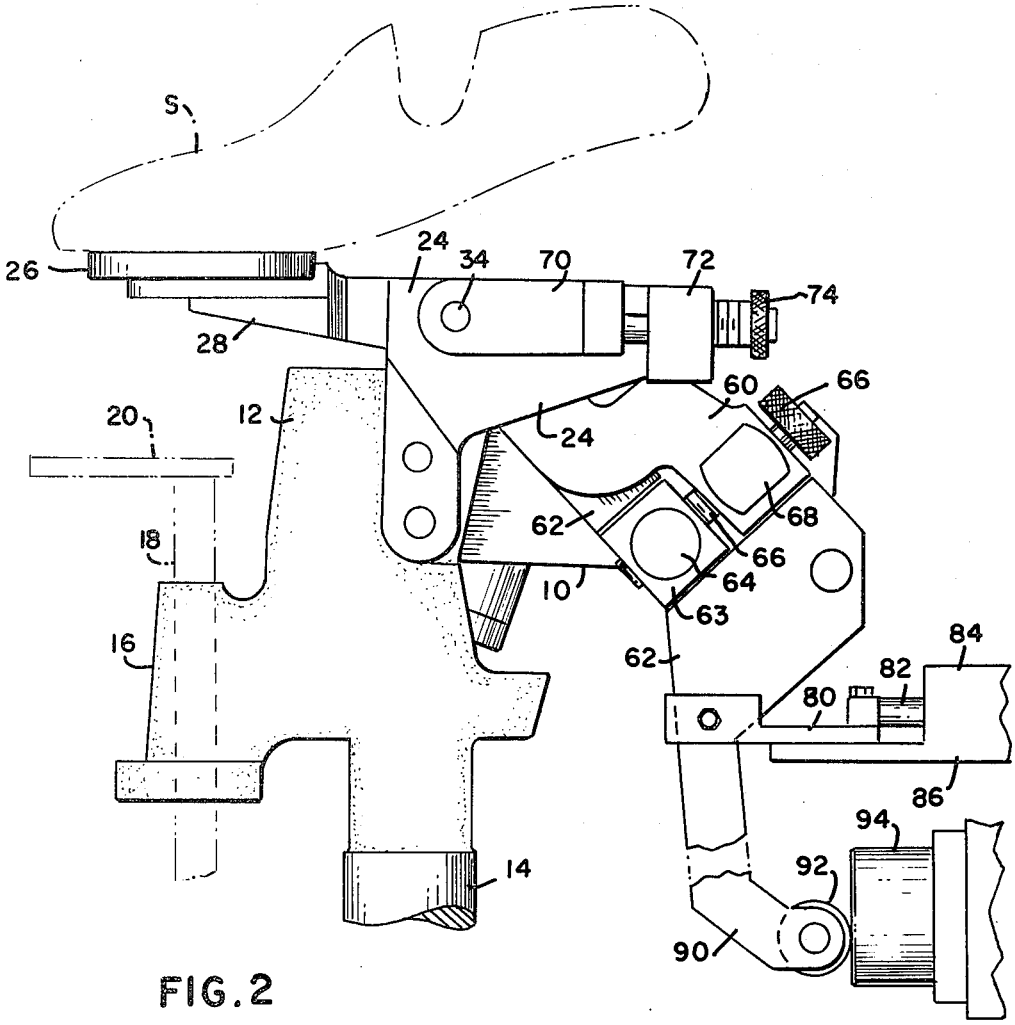
FIG. 2 is a side elevational view of one side of the insole support plate mechanism.

The forward support arm 28 has a lower support leg 60 affixed thereto, as shown in FIG. 2. The forward support arm 28 and the lower support leg 60 are pivotally arranged on the forwardmost axis 34. An elongated member 62, shown in FIG. 2, is also pivotally connected to the forwardmost axis 34 which is slidably disposed in the slot 36 in the frame members 22 and 24. A block 63 is secured to the support leg 60 at a midpoint thereon. The block 63 has a movable axis 64 therein, which threadably receives a threaded bolt 66. The threaded bolt 66 is also threadably received into a second movable axis 68 arranged in the distal end of the lower support leg 60.

A heelward travel adjustment arm 70 is disposed about the forwardmost axis 34. The adjustment arm 70 extends rearwardly in the direction of travel of the insole support plate 26. An adjustment block 72 is secured to the rearward end of the frame member 24.

A rearward stroke adjustment bolt 74 is in abuttable contact with the distal end of the adjustment arm 70 which bolt 74 is received in a threaded relationship with the adjustment block 72.

Figure 4:
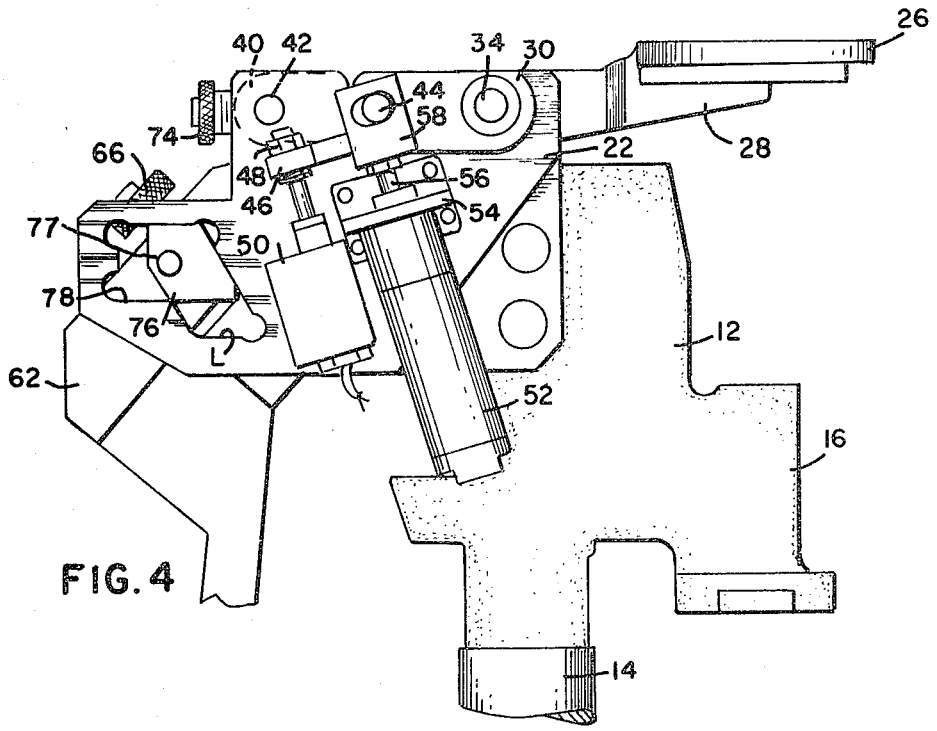
FIG. 4 is a view similar to that shown in FIG. 3 wherein the insole support plate mechanism is in a subsequent operational orientation.
Figure 3:
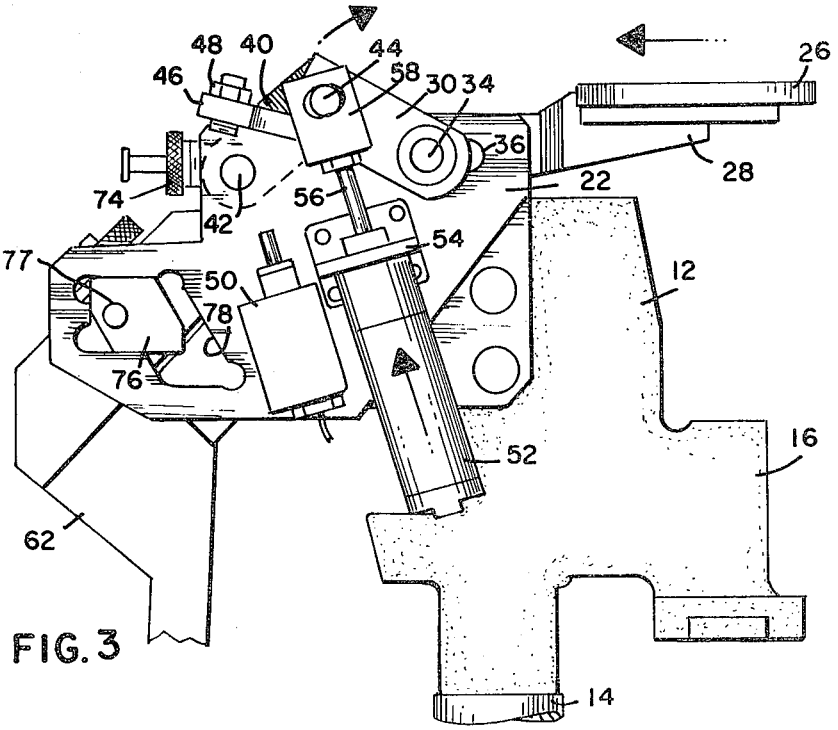
FIG. 3 is a side elevational view of the other side of the insole plate support mechanism in one operational orientation.

A cam 76 is journalled on a cam axis 77 secured to a side of the lower support leg 60. as shown in FIGS. 1, 3 and 4. The cam 76 is shaped in the general form of a parallelogram, and is slidably disposed in a cam slot 78, shaped generally in the form of two contiguous parallelograms forming an obtuse angle with one another, the cam slot 78 being cut into the frame member 22.

The elongated member 62 is received by a bifurcated shaft 80 attached to the distal end of a piston rod 82 of a piston, not shown, disposed in a double acting pressurizable positioning cylinder 84. The pressurizable cylinder 84 is secured to a frame portion 86 of the shoe machine. The elongated member 62 has a distal portion 90 with a wheel 92 rotatably arranged thereon. The wheel 92 is in rotational contact with a double acting pressurizable tilt cylinder 94 also secured to the frame 86 of the shoe machine.

In operation of the insole support plate mechanism 10, prior to the deposition with an upper and insole thereon onto the insole support plate 26, the positioning cylinder 84 is pressurized to retract the bifurcated shaft 80, while at the same time, the toggle break cylinder 52 is pressurized to cause the insole support plate 26, forward support arm 28 and the elongated member 62 to be shuttled rearwardly or heelwardly a prescribed distance. This distance of heelward movement is limited by the length of the slot 36 in the frame members 22 and 24, or it may also be regulatably limited by the spacial relationship of the rearward stroke adjustment bolt 74 and the distal end of the adjustment arm 70.

When the toggle break cylinder 52 is pressurized, it forces the intermediately disposed common axis 44 upwardly, causing the first pivot arms 30 and 32 to swing upwardly in conjunction with an upward swinging movement with the second pivot member 40 thereattached. The insole support plate 26, being secured to the support arm 28, is thus moved a prescribable distance heelwardly.

The angular disposition of the insole support plate 26 with respect to an imaginary horizontal plane, is controlled by the positional relationship of the lower support leg 60 and the block 63 attached to the elongated member 62 being threadably adjusted by the bolt 66 in registration therebetween.

The cam 76 slides rearwardly or heelwardly in the horizontal portion of the cam slot 78 as the toggle "breaks" and as the insole support plate 26 is moved heelwardly, as shown in FIG. 3.

When the positioning cylinder 84 is pressurized to advance the bifurcated arm 80 forwardly, the insole support plate 26 is caused to move forwardly or "toewardly", and the first pivot arms 30 and 32 together with the second pivot member 40 are returned to their straight or "unbroken" position. As the first pivot arms 30 and 32 return to their unbroken position, they sweep out a generally counterclockwise motion as might be seen in FIG. 4, and the extension 46 extending off of one of the arms 30, causes its adjustable bolt 48 thereon, to strike the actuatable control switch 50, thus initiating whatever subsequent steps are necessary in the shoe lasting process, through proper circuitry, not shown.

One of those steps may include the tilting upwardly of the insole support plate 26. This may occur only when the cam 76 is in the forwardmost upper corner of the cam slot 78, as shown in FIG. 4. The insole support plate 26 may then be tilted upwardly against its own weight by actuation and pressurization of the pressurizable tilt cylinder 94, pressing against (clockwise as shown in FIG. 2) the rotatable wheel 92 on the distal portion 90 of the elongated member 62. The cam 76 would then be caused to move into the lower portion of the cam slot 78, indicated by the letter "L" in FIG. 4. Retraction of the tilt cylinder 94 would cause the insole support plate 26 to return to whatever level it was set at by the adjustable bolt 66 in registration between the lower leg 60 and the elongated member 62.

Thus there has been shown an adjustable insole support plate for shoe lasting machines, which insole support plate may be moved to permit "high walled" type lasts or "short stocked" lasts to be suitable received thereon for gripping of the upper by an array of pincers therearound, not shown, providing an initial step towards satisfactory lasting thereof.

It is intended that the appended claims are to be interpreted in an exemplary manner and not in a limiting sense.

Having thus described my invention and what I claim as new and desire to secure as Letters Patent of the United States is:

1. A method of articulating a work support surface in a machine comprising:

attaching said work support surface to a first end of a support arm;

journalling a first axis through a second end of said work support arm and through a slot in a pair of frame members secured to said machine;

emplacing an arrangement of toggle links with said first axis and a fixed position second axis, said arrangement of toggle links having a common axis connecting them;

extending an extended member from said first axis to a reciprocating means secured to a frame portion of said machine;

and actuating said reciprocating means so as to cause said toggle link and said work support surface to move rearwardly.

2. A method of articulating a work support surface as recited in claim 1, wherein said method includes:

providing a cam mounted to the side of said elongated member;

arranging said cam in a cam slot in one of said frame members;

effectuating linear motion of said work support surface along the path of the longitudinal axis of said support arm prior to any alternate direction of motion of said work support surface by reactuating said reciprocating means to cause said cam in said cam slot to move to its forwardmost position therein.

3. A method of articulating a work support surface as recited in claim 2, further comprising:

providing the distal portion of said elongated member with a second reciprocating means; and actuating said second reciprocating means when said cam is in its upper forwardmost position in said cam slot to cause said cam to follow said cam slot to a lower position, permitting said work support surface to tilt upwardly about said first axis.

4. A method of articulating a work support surface as recited in claim 3, including:

retracting said second reciprocating means to cause said work support surface to return to a normal work position.

5. A method of articulating a work support surface as recited in claim 4, including:

directing an extended leg from said support arm to a position generally adjacent said elongated member, wherein said extended leg and said support arm may pivot about said first axis;

connecting the distal end of said extended leg to an abutment on said elongated member by a threaded bolt arranged therebetween;

and rotating said threaded bolt arranged between said elongated member and said extended arm to regulatably adjust the horizontal positioning of said work support surface.

6. A method of articulating a work support surface as recited in claim 4, including:

limiting the amount of rearward motion of said first axis in said slot in said frame members by providing an arm on said first axis into abutting contact with an adjustable bolt threadably attached to one of said frame members.

7. A method of articulating a work support surface as recited in claim 6, including:

rotating said threaded bolt attached to one of said frame members to limit the amount of rearward travel of said work supporting surface during actuation of said reciprocating means.

8. A method of articulating a work support surface as recited in claim 6, wherein limitation of the amount of rearward motion of said first axis is said slot in said frame also effectuates a proportionate amount limitation of rearward travel of said cam in said cam slot.

9. A method of articulating a work support surface as recited in claim 6, including:

pressurizing a third reciprocating means to effectuate the initial pivoting of said toggling arrangement about their common axis, said third reciprocating means comprising a pneumatic cylinder secured to one of said frame members and an extension on said common axis.

* * * * *